US011049630B2

(12) United States Patent
Huang et al.

(10) Patent No.: US 11,049,630 B2
(45) Date of Patent: Jun. 29, 2021

(54) MULTICORE CABLE

(71) Applicant: Hitachi Metals, Ltd., Tokyo (JP)

(72) Inventors: Detian Huang, Tokyo (JP); Yoshinori Tsukamoto, Tokyo (JP); Masanori Kobayashi, Tokyo (JP); Masashi Moriyama, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 16/843,603

(22) Filed: Apr. 8, 2020

(65) Prior Publication Data

US 2021/0151221 A1 May 20, 2021

(30) Foreign Application Priority Data

Nov. 20, 2019 (JP) ..... JP2019-209310

(51) Int. Cl.

| | |
|---|---|
| ***H01B 11/04*** | (2006.01) |
| ***H01B 9/02*** | (2006.01) |
| ***H01B 7/02*** | (2006.01) |
| ***H01B 13/26*** | (2006.01) |
| ***H01B 13/14*** | (2006.01) |
| ***H01B 7/18*** | (2006.01) |

(52) U.S. Cl.

CPC ..... *H01B 9/024* (2013.01); *H01B 7/0275* (2013.01); *H01B 7/187* (2013.01); *H01B 13/14* (2013.01); *H01B 13/2606* (2013.01)

(58) Field of Classification Search

CPC ..... H01B 11/04; H01B 11/06

See application file for complete search history.

(56) References Cited

U.S. PATENT DOCUMENTS 4,719,320 A * 1/1988 Strait, Jr. ..... H01B 11/1878 174/106 R
4,761,519 A * 8/1988 Olson ..... H01B 7/041 156/51
5,414,215 A * 5/1995 Dunand ..... H01B 7/0009 174/109

(Continued)

FOREIGN PATENT DOCUMENTS

JP 6394721 B2 9/2018

*Primary Examiner* — Chau N Nguyen

(74) *Attorney, Agent, or Firm* — McGinn I.P. Law Group, PLLC.

(57) ABSTRACT

A multicore cable is composed of a bunched core composed of a plurality of electric wires laid together, each including a conductor, and an electrical insulating member provided over a periphery of the conductor, an abrasion suppressing layer configured as a taping member helically wrapped around a periphery of the bunched core, a shielding layer composed of a braided shield provided over an outer periphery of the abrasion suppressing layer, and a sheath provided over a periphery of the shielding layer. An opposite surface of the taping member constituting the abrasion suppressing layer to the bunched core and an opposite surface of the taping member constituting the abrasion suppressing layer to the shielding layer are composed of a fluoropolymer resin. The taping member constituting the abrasion suppressing layer is non-adhesively lap wound in such a manner as to partially overlap itself in a width direction thereof.

18 Claims, 4 Drawing Sheets

(56) References Cited

U.S. PATENT DOCUMENTS

| | | | | |
|---|---|---|---|---|
| 6,596,393 | B1 * | 7/2003 | Houston | C23F 11/149 428/389 |
| 8,426,734 | B2 * | 4/2013 | Wandler | A61B 5/04286 174/113 R |
| 10,020,095 | B1 | 7/2018 | Huang et al. | |
| 10,217,548 | B2 | 2/2019 | Huang et al. | |
| 2002/0129969 | A1 * | 9/2002 | Groegl | H01B 7/041 174/128.1 |
| 2009/0236119 | A1 * | 9/2009 | Wessels, Jr. | H01B 11/04 174/113 AS |
| 2014/0199897 | A1 * | 7/2014 | DeSantis | H01R 4/183 439/878 |
| 2014/0251651 | A1 * | 9/2014 | Huang | H01B 11/1033 174/34 |
| 2018/0277284 | A1 | 9/2018 | Huang et al. | |
| 2019/0267151 | A1 * | 8/2019 | Kusakari | H01B 1/023 |

* cited by examiner

MULTICORE CABLE

CROSS-REFERENCE TO RELATED APPLICATIONS

The present invention is based on Japanese Patent Application No. 2019-209310 filed on Nov. 20, 2019, the entire contents of which are incorporated herein by reference.

BACKGROUND OF THE INVENTION

1. Field of the Invention

The present invention relates to a multicore cable.

2. Description of the Related Art

In recent years, for a productivity enhancing measure, the market for collaborative robots or small articulated robots is expanding. As robot cables to be used in such a robot, a movable part cable designed to be wired in a movable part of that robot and a fixed part cable designed to connect that robot and a control device are used.

As the movable part cable, there is known a multicore cable, which is configured to include a bunched core composed of a plurality of electric wires laid together, a shielding layer composed of a braided shield and provided over a periphery of that bunched core, and a sheath provided over a periphery of that shielding layer. Such a multicore cable is used not only in a robot cable but also, for example, in an unsprung wiring in an automobile, or the like.

Note that Japanese Patent No. 6394721 has been disclosed as prior art document information relevant to the invention of the present application.

[Patent Document 1] Japanese Patent No. 6394721

SUMMARY OF THE INVENTION

In the above-described conventional multicore cable, when the multicore cable is repeatedly bent, between the braided shield being used in the shielding layer and respective constituent electrical insulating members of the plurality of electric wires constituting the bunched core, there occurs a lateral pressure friction, causing abrasion and subsequent local wearing away or the like of the electrical insulating members of the plurality of electric wires, leading to concern that a failure such as a deterioration in properties of the multicore cable, or a short circuit between respective constituent conductors of the plurality of electric wires constituting the bunched core and the shielding layer, or a wire break, or the like, may occur.

In view of the foregoing, it is an object of the present invention to provide a multicore cable that is designed to be resistant to the occurrence of a failure such as a wire break or the like when repeatedly bent.

For the purpose of solving the above-described problems, the present invention provides a multicore cable, comprising: a bunched core composed of a plurality of electric wires laid together, each including a conductor, and an electrical insulating member provided over a periphery of the conductor; an abrasion suppressing layer configured as a taping member helically wrapped around a periphery of the bunched core; a shielding layer composed of a braided shield provided over an outer periphery of the abrasion suppressing layer; and a sheath provided over a periphery of the shielding layer, wherein an opposite surface of the taping member of the abrasion suppressing layer to the bunched core and an opposite surface of the taping member of the abrasion suppressing layer to the shielding layer are composed of a fluoropolymer resin, with the taping member of the abrasion suppressing layer being non-adhesively lap wound in such a manner as to partially overlap itself in a width direction of that taping member.

Points of the Invention

According to the present invention, it is possible to provide the multicore cable that is designed to be resistant to the occurrence of a failure such as a wire break or the like when repeatedly bent.

DETAILED DESCRIPTION OF THE PREFERRED EMBODIMENTS

[Embodiment]

An embodiment of the present invention will be described below in conjunction with the accompanying drawings.

Figure 1A:
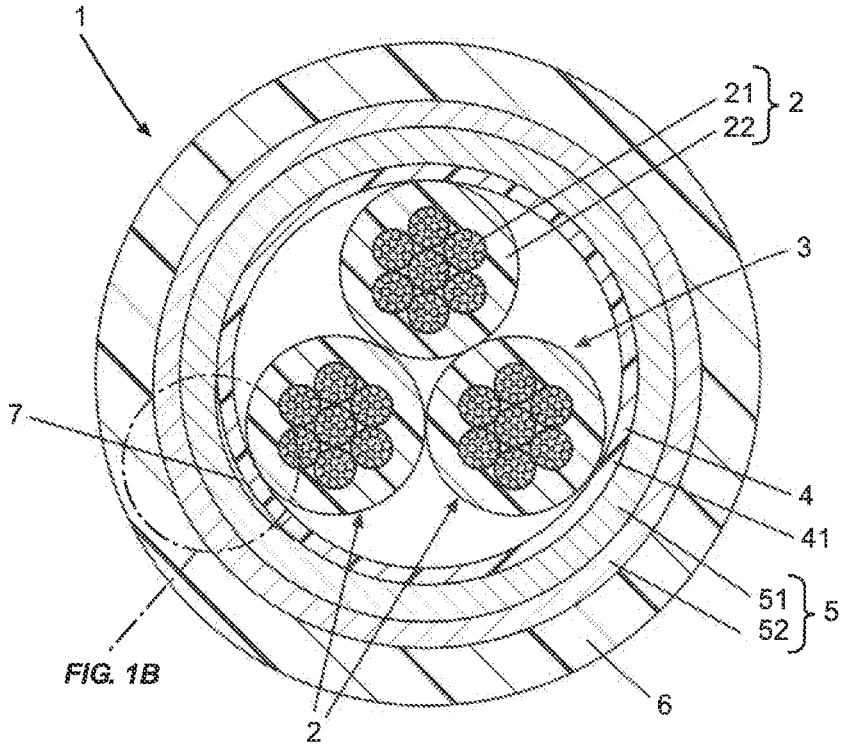
FIG. 1A is a cross-sectional view showing a cable cross section perpendicular to a cable longitudinal direction of a multicore cable according to one embodiment of the present invention.
Figure 1B:
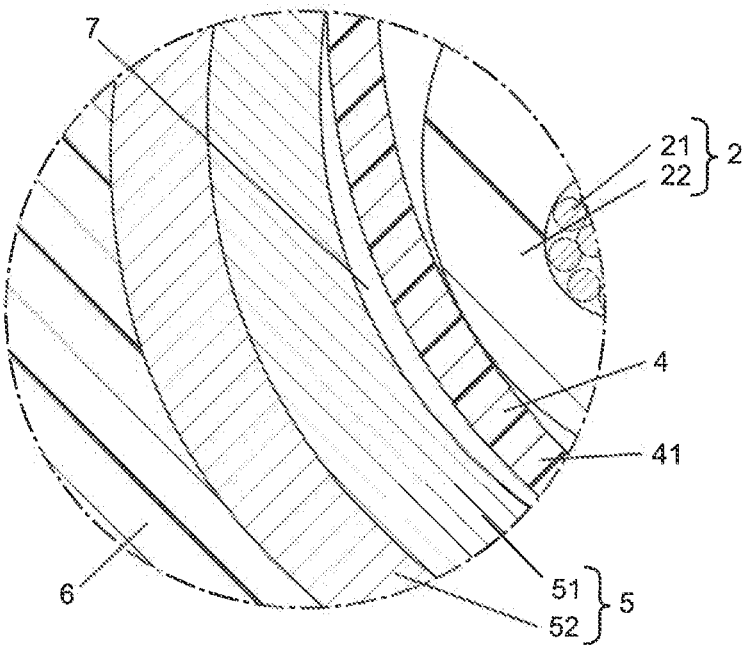
FIG. 1B is an enlarged view showing a portion A of the multicore cable shown in FIG. 1A.

FIG. 1A is a cross-sectional view showing a cable cross section perpendicular to a cable longitudinal direction of a multicore cable 1 according to the present embodiment, and FIG. 1B is an enlarged view showing a portion A of the multicore cable 1 shown in FIG. 1A.

As shown in FIGS. 1A and 1B, the multicore cable 1 is configured to include a bunched core 3, which is composed of a plurality (in FIGS. 1A and 1B, three) of electric wires 2 laid together, each including a conductor 21, and a electrical insulating member 22 provided over a periphery of the conductor 21, an abrasion suppressing layer 4, a shielding layer 5, and a sheath 6, which are in turn being provided over a periphery of that bunched core 3. The multicore cable 1 is the one designed to be used in, for example, a wiring in an interior or exterior side of a robot designed to be used in a factory or the like, or an unsprung wiring in an automobile (that is, a wiring designed to connect a device provided in a wheel of that automobile, such as a braking device or a sensor of various kinds, and a device provided in a vehicle body of that automobile, such as a controlling device), or the like, and the multicore cable 1 is the one designed to be provided in such an arrangement that at least a part thereof strides over a movable part or a swingable part.

(Electric Wires 2)

The conductors 21 of the plurality of electric wires 2 are made of a composite stranded wire produced by using a plurality of child stranded wires each composed of a plurality of metal wires made of a copper or the like stranded together, and further stranding the plurality of child stranded wires together. The plurality of child stranded wires are each produced by bunched stranding of the plurality of metal wires together, and the conductors 21 of the plurality of electric wires 2 are each produced by concentric stranding of the plurality of child stranded wires together. By configuring the conductors 21 of the plurality of electric wires 2 by the composite stranding, the multicore cable 1 is made high in flexibility to thereby be able to facilitate the wiring of the multicore cable 1, and in addition, even when the multicore cable 1 is subjected to repeated bendings or torsions in a movable part, the multicore cable 1 becomes resistant to the occurrence of a wire break in the metal wires constituting the conductors 21 of the plurality of electric wires 2, and so the multicore cable 1 is enhanced in bending resistance and torsion resistance. In addition, by making the conductors 21 of the plurality of electric wires 2 from the above-described composite stranded wire, the conductors 21 of the plurality of electric wires 2 are effectively made resistant to the occurrence of a wire break or the like even when the multicore cable 1 is acted on by such a load as to jerk the multicore cable 1.

In order to sufficiently impart the bending resistance and the torsion resistance to the multicore cable 1, as the metal wires to be used in the conductors 21 of the plurality of electric wires 2, the metal wires having a tensile strength of not lower than 220 MPa and an elongation of not lower than 5% may be used. Further, in order to keep the attenuation in a long distance transmission small, the conductor cross-sectional areas of the conductors 21 of the plurality of electric wires 2 may be not smaller than 0.75 $mm^2$. In the present embodiment, each of the conductors 21 of the three electric wires 2 can be constituted by the use of, for example, tin-plated soft copper wires having a wire diameter of 0.08 mm as the metal wires to be used in the conductors 21 of the three electric wires 2, and by the concentric stranding together of seven of the child stranded wires each composed of thirty of those tin-plated soft copper wires. At this point of time, the outer diameters of the conductors 21 of the three electric wires 2 are about 1.41 mm, and the conductor cross-sectional areas of the conductors 21 of the three electric wires 2 are about 1.04 $mm^2$.

The electrical insulating members 22 of the plurality of electric wires 2 are formed in such a manner as to coat the peripheries of the conductors 21 of the plurality of electric wires 2 respectively. As the electrical insulating members 22 of the plurality of electric wires 2, it is possible to use, for example, the electrical insulating members having a single layer structure made of a PVC (polyvinyl chloride), a PE (polyethylene), an ETFE (tetrafluoroethylene-ethylene copolymer), an FEP (tetrafluoroethylene-hexafluoropropylene copolymer), or the like. Alternatively, as the electrical insulating members 22 of the plurality of electric wires 2, it is possible to use, for example, the electrical insulating members having a two-layer structure whose inner layer is made of a PVC (polyvinyl chloride) and whose outer layer is made of an ETFE (tetrafluoroethylene-ethylene copolymer), or a two-layer structure whose inner layer is made of a foamed polyethylene and whose outer layer is made of a non-foamed polyethylene.

Note that, when the transmission properties of a high frequency signal are enhanced (more specifically, for example, when a high frequency signal in a band of 10 MHz to 6 GHz is made resistant to being attenuated in a long distance transmission thereof), as the electrical insulating members 22 of the plurality of electric wires 2, it is desirable to use the electrical insulating members having as low a dielectric constant as possible. For example, as the electrical insulating members 22 of the plurality of electric wires 2, it is possible to use the electrical insulating members having a three-layer structure configured to include a non-solid extruded layer, which is provided on the outer peripheries of the conductors 21 of the plurality of electric wires 2 by tube extrusion using a non-foamed resin material having a low dielectric constant, a foamed layer, which is non-adhesively provided on the outer periphery of that non-solid extruded layer, and a non-foamed layer, which is adhesively provided on the outer periphery of that foamed layer. For the non-solid extruded layer, it is possible to use, for example, a fluoropolymer resin material made of an FEP (tetrafluoroethylene-hexafluoropropylene copolymer), a PFA (tetrafluoroethylene-perfluoroalkylvinyl ether copolymer), or the like. Further, for the foamed layer, a resin material having a lower melting point than that of the fluoropolymer resin material used in the non-solid extrusion layer may be used. For example, for the foamed layer, it is possible to use the resin material made of an irradiation crosslinked foamed polyethylene, or a foamed polypropylene, or the like. Further, the non-foamed layer may be made of the same resin material as that of the foamed layer. For example, for the non-foamed layer, it is possible to use the resin material made of a non-foamed polypropylene, or an irradiation crosslinked polyethylene, or the like.

(Bunched Core 3)

The bunched core 3 is constituted by laying the three electric wires 2 together. It should be noted, however, that the number of the electric wires 2 constituting the bunched core 3 is not limited to the above number. Further, although in the present embodiment, all of the plurality of electric wires 2 constituting the bunched core 3 have the same configurations, the configurations of the plurality of electric wires 2 are not limited to the foregoing, but, for example, it is possible to use the plurality of electric wires 2 being different from each other in the outer diameter or in the conductor cross-sectional area. Further, in order to make the outer shape of the multicore cable 1 close to a circular shape, the bunched core 3 may be configured in such a manner that a filling member is laid along with the plurality of electric wires 2. As the filling member, it is possible to use, for example, a thread-like shape body such as a staple fiber yarn or the like, or a linear shape body made of a polyethylene or the like.

(Abrasion Suppressing Layer 4)

Figure 4:
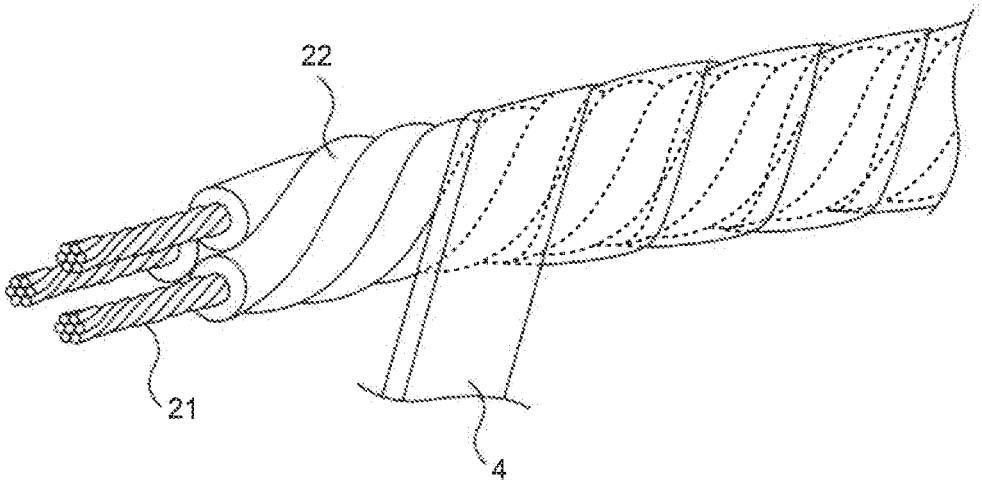
FIG. 4 is an oblique view showing a shielded multicore cable of an embodiment of the present invention.

The abrasion suppressing layer 4 is configured as a taping member 41 made of a fluoropolymer resin tape helically wrapped around a periphery of the bunched core 3. For example, providing the abrasion suppressing layer 4 by extrusion molding is also considered, but, in this case, the abrasion suppressing layer 4 is formed in a cylindrical shape, so the abrasion suppressing layer 4 becomes very hard and difficult to bend, leading to a lowering in the flexibility of the multicore cable 1. That is, in the present embodiment, in order to suppress the occurrence of a lowering in the flexibility of the multicore cable 1, and in order to, when repeatedly bending the multicore cable 1, suppress the occurrence of an abrasion in the electrical insulating members 22 of the plurality of electric wires 2 resulting from a lateral pressure abrasion caused between the shielding layer 5, which is composed of a plurality of metal wires, and those electrical insulating members 22 made of the electrically insulative resin material, the abrasion suppressing layer 4 is formed by helically wrapping the taping member 41 made of a fluoropolymer resin tape around the periphery of the bunched core 3. Note that, as shown in FIG. 4, a wrapping direction of the taping member 41 of the abrasion suppressing layer 4 may be the same as a lay direction of the bunched core 3. This allows the taping member 41 to be easily passed into the depressed portions (the valley portions) of the bunched core 3, that is, the valley portions between adjacent ones of the plurality of electric wires 2 constituting the bunched core 3 in a circumferential direction of the abrasion suppressing layer 4, to increase the contact area between the taping member 41 constituting the abrasion suppressing layer 4 and the plurality of electric wires 2 constituting the bunched core 3, to thereby be able to further suppress the occurrence of an abrasion in the plurality of electric wires 2 due to the shielding layer 5. In the present embodiment, when the taping member 41 has been passed into the valley portions between adjacent ones of the plurality of electric wires 2 in the circumferential direction of the abrasion suppressing layer 4, an air layer is formed between the taping member 41 having been passed into those valley portions and the shielding layer 5.

As shown in FIG. 4, the taping member 41 constituting the abrasion suppressing layer 4 is helically wrapped around the outer periphery of the bunched core 3, by being lap wound therearound in such a manner that the fluoropolymer resin tape to form the taping member 41 partially overlaps itself in a width direction thereof. At this point of time, the taping member 41 is lap wound around the outer periphery of the bunched core 3 in such a manner that, when the multicore cable 1 is bent or swung, or when the multicore cable 1 is moved in such a manner as to be jerked, the taping member 41 acts to maintain a state in which the surfaces of the plurality of electric wires 2 (the electrical insulating members 22 thereof) are not exposed from the overlapped portions of the taping member 41. Further, the overlapped portions of the taping member 41 are not being adhered to each other, so that, when the multicore cable 1 is bent or swung, or when the multicore cable 1 is moved in such a manner as to be jerked, the overlapped portions of the taping member 41 can be moved in such a manner as to be slid relative to each other in the longitudinal direction of the multicore cable 1.

Further, it is desirable that the fluoropolymer resin tape to constitute the taping member 41 of the abrasion suppressing layer 4 includes two non-adhesive surfaces that are not adhered to the electrical insulating members 22 of the plurality of electric wires 2 constituting the bunched core 3, and to the shielding layer 5. Note that the "taping member made of a fluoropolymer resin tape" described herein refers to the taping member configured with a tape uniformly formed of a fluoropolymer resin. In addition, in order to achieve the above-described actions and advantageous effects of the taping member 41, it is desirable that the taping member 41 is lap wound around the outer periphery of the bunched core 3 in such a manner that the widths of the overlapped portions of the fluoropolymer resin tape to form the taping member 41 are not less than 0.3 times and not more than 0.5 times the width (for example, 15 mm to 35 mm) of that fluoropolymer resin tape.

When the multicore cable 1 is repeatedly bent (especially when the multicore cable 1 is acted on by such a load as to jerk the multicore cable 1), the multicore cable 1 is acted on by a lateral pressure, but, in the multicore cable 1 according to the present embodiment, since the above-described abrasion suppressing layer 4 is provided between the electrical insulating members 22 of the plurality of electric wires 2 constituting the bunched core 3 and the shielding layer 5, it is possible to suppress the occurrence of an abrasion in the electrical insulating members 22 of the plurality of electric wires 2 resulting from the electrical insulating members 22 of the plurality of electric wires 2 and the shielding layer 5 being rubbed against each other due to the lateral pressure. That is, by providing the abrasion suppressing layer 4 between the electrical insulating members 22 of the plurality of electric wires 2 constituting the bunched core 3 and the shielding layer 5, since the first surface of the abrasion suppressing layer 4 being brought into contact with the electrical insulating members 22 of the plurality of electric wires 2 and the second surface of the abrasion suppressing layer 4 being brought into contact with the shielding layer 5 are resistant to being abraded by the lateral pressure, it is possible to enhance the durability of the multicore cable 1 against being repeatedly bent, particularly the durability of the multicore cable 1 against being acted on by such a load as to jerk the multicore cable 1 (hereinafter, referred to as simply the durability of the multicore cable 1 against being jerked).

It is desired that, when the multicore cable 1 is bent or swung, or when the multicore cable 1 is moved in such a manner as to be jerked, in order for the shielding layer 5 to be able to move in such a manner as to slide relative to the abrasion suppressing layer 4, the two surfaces of the abrasion suppressing layer 4 are slippery (the coefficients of a friction on the two surfaces of the abrasion suppressing layer 4 are lower than the coefficients of the friction on the surfaces of the electrical insulating members 22 of the plurality of electric wires 2). Examples of the fluoropolymer resin tape to be used in the taping member 41 of the abrasion suppressing layer 4 include an ETFE (tetrafluoroethylene-ethylene copolymer) tape, a PTFE (polytetrafluoroethylene) tape, and the like. In the present embodiment, the taping member 41 of the abrasion suppressing layer 4 being made of the PTFE having not only a slippery surface but also a low dielectric constant is used.

The thickness of the taping member 41 of the abrasion suppressing layer 4 is preferably not less than 25 μm and not more than 150 μm. This is because, when the thickness of the taping member 41 of the abrasion suppressing layer 4 is not less than 25 μm, the taping member 41 becomes resistant to being fractured by being repeatedly abraded, or when the thickness of the taping member 41 of the abrasion suppressing layer 4 is not more than 150 μm, the abrasion suppressing layer 4 has such a hardness as to allow the multicore cable 1 to become resistant to being lowered in flexibility. In the present embodiment, for example, the taping member 41 made of the PTFE tape having a thickness of 100 μm can be used.

Figure 2A:
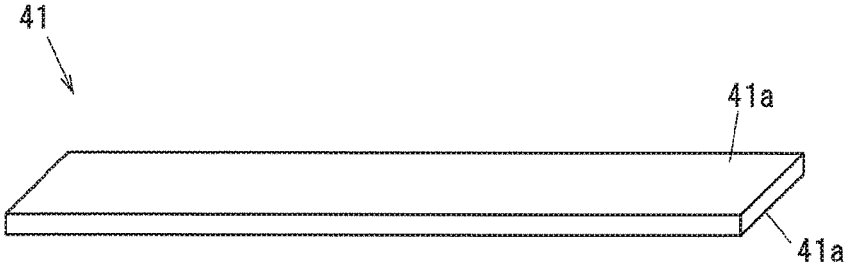
FIG. 2A is a perspective view showing a taping member.
Figure 2B:
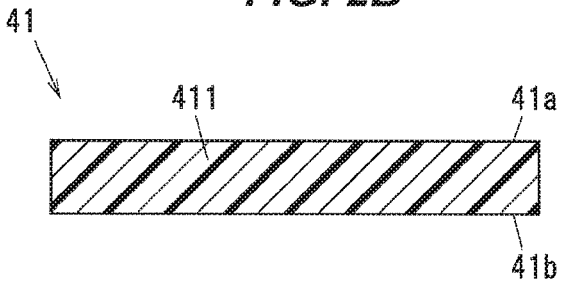
FIGS. 2B to 2D are cross-sectional views showing taping members respectively.
Figure 2C:
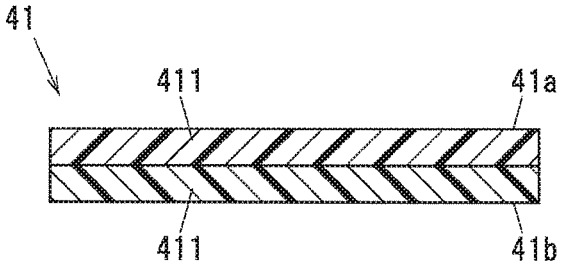
Figure 2D:
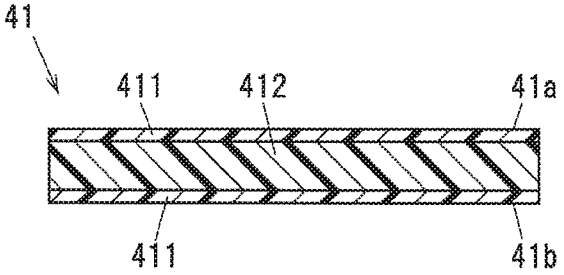

Although in the present embodiment, as shown in FIGS. 2A and 2B, the taping member 41 made of the (single layer) fluoropolymer resin tape having one fluoropolymer resin layer 411 is used, the configuration of the taping member 41 is not limited to the foregoing, but the taping member 41 may be configured in such a manner that the opposite surface 41*a* thereof to the bunched core 3 and the opposite surface 41*b* thereof to the shielding layer 5 are configured with the fluoropolymer resin. For example, as shown in FIGS. 2C and 2D, the taping member 41 may have a multilayer structure composed of two or more layers. FIG. 2C shows an example in which the two opposite surfaces 41*a* and 41*b* of the taping member 41 to the bunched core 3 and to the shielding layer 5 respectively are both configured with the fluoropolymer resin by laminating multiple layers (in the illustrated example, two layers) of the fluoropolymer resin layers 411 on top of each other. The taping member 41 in FIG. 2C can be formed, for example, by laminating together or the like of two films made of the fluoropolymer resin. Further, FIG. 2D shows an example in which the two opposite surfaces 41*a* and 41*b* of the taping member 41 to the bunched core 3 and to the shielding layer 5 respectively are both configured with the fluoropolymer resin by providing the two fluoropolymer resin layers 411 on both surfaces, respectively, of a base material 412. The taping member 41 in FIG. 2D is formed, for example, by applying the fluoropolymer resin to both the entire surfaces of the base material 412, and curing that applied fluoropolymer resin to form the fluoropolymer resin layers 411 on both the entire surfaces, respectively, of the base material 412, or laminating two films made of the fluoropolymer resin to both the entire surfaces, respectively, of the base material 412, and fusing those two films and that base material 412 together.

(Shielding Layer 5)

The shielding layer 5 is the one designed for external noise shielding. In order to ensure the flexibility of the multicore cable 1, the shielding layer 5 being provided over the outer periphery of the abrasion suppressing layer 4 is composed of a braided shield with metal wires being braided together therein. In the present embodiment, the shielding layer 5 is constituted by laminating a plurality of layers of the braided shields on top of each other. Herein, a case in which the shielding layer 5 is constituted by laminating two layers of the braided shields on top of each other will be described, but the shielding layer 5 may be constituted by laminating three or more layers of the braided shields on top of each other. Hereinafter, a first one of the two layers of the braided shields, which is provided in an inner side of the shielding layer 5 in radial directions of the multicore cable 1, will be referred to as the inner braided shield 51, while a second one of the two layers of the braided shields, which is provided in an outer side of the shielding layer 5 in the radial directions of the multicore cable 1, will be referred to as the outer braided shield 52.

In the multicore cable 1 according to the present embodiment, an air layer 7 may be formed partially in the circumferential direction thereof between the shielding layer 5 (the inner braided shield 51 of the shielding layer 5) and the abrasion suppressing layer 4. In order to form the air layer 7, the inner diameter of the inner braided shield 51 may be configured in such a manner as to be larger than the outer diameter of the abrasion suppressing layer 4. In the present embodiment, the air layer 7 can be formed by, when forming the inner braided shield 51, arranging a rod-shaped spacer, which is built in, for example, a braid forming device, along the cable longitudinal direction of the multicore cable 1 on the outer periphery of the abrasion suppressing layer 4, braiding the metal wires together on that spacer to form the inner braided shield 51, and in turn sending the formed inner braided shields 51 out of the braid forming device in such a manner as to withdraw the formed inner braided shields 51 from the spacer. Note that, even when such a production method is not performed, micro gaps are formed in an uneven portion of the taping member 41 of the abrasion suppressing layer 4 (an uneven portion of the taping member 41 resulting from the partial overlapping of the taping member 41 in the width direction of the taping member 41) or between the metal wires of the inner braided shield 51 as well, but that such micro gaps are not included in the air layer 7 of the present invention. Further, the shape of the spacer is not limited to the above rod shape. The size of the air layer 7 refers to such a state that the shielding layer 5 is floating from the surface of the abrasion suppressing layer 4 to the sheath 6 side, within a range of the maximum distance from the surface of the abrasion suppressing layer 4 to the inner surface of the shielding layer 5 (the opposite surface of the shielding layer 5 to the surface of the abrasion suppressing layer 4) of not less than 5 μm and not more than 30 μm. The maximum distance is determined by measuring the maximum value of the distance in a straight line from the surface of the abrasion suppressing layer 4 to the inner surface of the shielding layer 5, when cutting the multicore cable 1 at a predetermined position thereon and subsequently observing the cable transverse cross section (the cable cross section perpendicular to the cable longitudinal direction of the multicore cable 1) of the cut portion of the multicore cable 1 using an optical microscope or an electron microscope.

By forming the air layer 7 between the shielding layer 5 (the inner braided shield 51 of the shielding layer 5) and the abrasion suppressing layer 4, the tightening of the abrasion suppressing layer 4 caused by the shielding layer 5 is suppressed, and so when the multicore cable 1 is bent, swung or jerked, the shielding layer 5 (the inner braided shield 51 of the shielding layer 5) and the abrasion suppressing layer 4 can easily be moved relative to each other in the longitudinal direction of the multicore cable 1, and the bending resistance of the multicore cable 1, the torsion resistance of the multicore cable 1, and the durability of the multicore cable 1 against being jerked can be enhanced.

The outer braided shield 52 of the shielding layer 5 is formed by braiding the metal wires together on the outer periphery of the inner braided shield 51 of the shielding layer 5, in the same manner as in a typical braided shield producing method. This is because, if an air layer is formed between the inner braided shield 51 and the outer braided shield 52 constituting the shielding layer 5, the contact resistance therebetween within the shielding layer 5 becomes high, leading to concern that a deterioration in the properties of the multicore cable 1 may occur.

In order to sufficiently impart the bending resistance and the torsion resistance to the multicore cable 1, the metal wires to be used in both the inner braided shield 51 and the outer braided shield 52 constituting the shielding layer 5 have a tensile strength of not lower than 340 MPa and an elongation of not lower than 5%. In the present embodiment, for example, as the metal wires to be used in both the inner braided shield 51 and the outer braided shield 52 constituting the shielding layer 5, the metal wires made of a tin-plated copper alloy having a wire diameter of 0.08 mm can be used. Further, the densities of both the inner braided shield 51 and the outer braided shield 52 are set at about 90%. Note that the metal wires to be used in both the inner braided shield 51 and the outer braided shield 52 may be of the same or different wire diameters.

In addition, in the present embodiment, the metal wires coated with a lubricant agent can be used in both the inner braided shield 51 and the outer braided shield 52 constituting the shielding layer 5. As the lubricant agent, for example, a liquid paraffin can be used. This allows the shielding layer 5 and the abrasion suppressing layer 4 to be more easily slid relative to each other, and so the bending resistance of the multicore cable 1, the torsion resistance of the multicore cable 1, and the durability of the multicore cable 1 against being jerked can be further enhanced.

Figure 5:
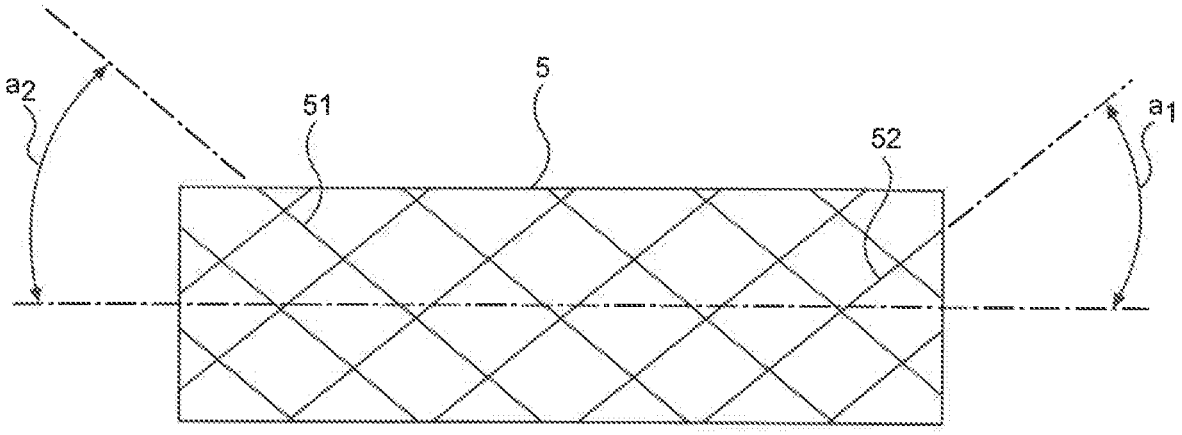
FIG. 5 is a side view of a shielding layer of an embodiment of the resent invention.

Now, as shown in FIG. 5, if the braiding angle $a_2$ of the inner braided shield 51 of the shielding layer 5 is large, there is concern that the rubbing between the inner braided shield 51 and the abrasion suppressing layer 4 may become severe. Further, if the braiding angle $a_1$ of the outer braided shield 52 of the shielding layer 5, which is easily affected by bending, is small, a wire break is highly likely to occur in the metal wires of the outer braided shield 52, leading to concern that the bending resistance may be lowered. Further, if the braiding angles of both the inner braided shield 51 and the outer braided shield 52 are the same, there is concern that there may be an increase in the abrasion between both the inner braided shield 51 and the outer braided shield 52. Thus, the braiding angle $a_2$ of the inner braided shield 51 may be smaller than the braiding angle $a_1$ of the outer braided shield 52. When the shielding layer 5 is configured in such a manner as to include three or more layers of the braided shields, the braiding angle of the innermost braided shield, which is provided in the innermost side of the shielding layer 5 in the radial directions of the multicore cable 1, may be smaller than the braiding angles of the outer braided shields, which are provided in the outer side of the shielding layer 5 relative to that innermost braided shield in the radial directions of the multicore cable 1. Note that the braiding angle refers to the angle (the absolute value of the angle) formed by the longitudinal direction of the metal wires of the shielding layer 5 and the longitudinal direction of the multicore cable 1.

(Sheath 6)

The sheath 6 is formed in such a manner as to cover the periphery of the shielding layer 5. As the sheath 6, for example, the sheath made of a PVC (polyvinyl chloride) or a urethane can be used. In the present embodiment, the sheath 6 made of the PVC is used. The sheath 6 is desirably formed by tube extrusion so that the shielding layer 5 can be moved within the sheath 6.

(Actions and Advantageous Effects of the Embodiment)

As described above, and shown in FIG. 4, the multicore cable 1 according to the present embodiment is configured to include the abrasion suppressing layer 4 formed by helically wrapping the taping member 41 around the periphery of the bunched core 3 between the bunched core 3 and the shielding layer 5, wherein the opposite surface 41*a* of the taping member 41 of the abrasion suppressing layer 4 to the bunched core 3 and the opposite surface 41*b* of the taping member 41 of the abrasion suppressing layer 4 to the shielding layer 5 are composed of the fluoropolymer resin, with the taping member 41 of the abrasion suppressing layer 4 being non-adhesively lap wound in such a manner as to partially overlap itself in the width direction of that taping member 41. This makes it possible to achieve the multicore cable 1 designed to be resistant to the occurrence of a failure such as a wire break or the like when repeatedly bent, and makes it possible to achieve the multicore cable 1 designed to be high in the durability against bending, swinging and jerking. Further, according to the present embodiment, even when the conductor cross-sectional areas of the conductors 21 of the plurality of electric wires 2 are made relatively large, since the durability against bending, swinging, and jerking is sufficiently achieved, the multicore cable 1 having the electrical properties suitable for a long distance transmission can easily be achieved.

(Modification)

Although in the above embodiment, all of the plurality of electric wires 2 constituting the bunched core 3 have the same configurations, the configurations of the plurality of electric wires 2 constituting the bunched core 3 may not be the same, so the specific configuration of the bunched core 3 is not particularly limited. For example, as in a multicore cable la shown in FIG. 3, two power supply wires 2*a* and 2*a*, which are designed to supply electric power, and two signal wires 2*b* and 2*b*, which are designed for signal transmission, may be used as the plurality of electric wires 2 to constitute the bunched core 3, and the bunched core 3 may be configured by laying a twisted wire pair 24 with the two signal wires 2*b* and 2*b* twisted together therein and the two power supply wires 2*a* and 2*a* together.

Figure 3:
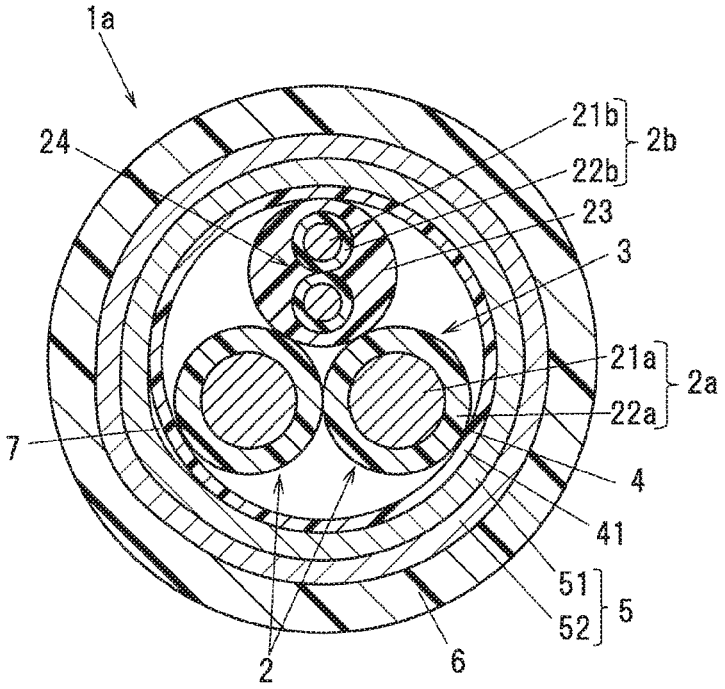
FIG. 3 is a cross-sectional view showing a cable cross section perpendicular to a cable longitudinal direction of a multicore cable according to one modification to the present invention.

The two power supply wires 2*a* and 2*a* are each being configured in such a manner that a constituent conductor 21*a* of each of those two power supply wires 2*a* and 2*a* is coated with a constituent electrical insulating member 22*a* of each of those two power supply wires 2*a* and 2*a* therearound, while the two signal wires 2*b* and 2*b* are each being configured in such a manner that a constituent conductor 21*b* of each of those two signal wires 2*b* and 2*b* is coated with a constituent electrical insulating member 22*b* of each of those two signal wires 2*b* and 2*b* therearound. The conductor sectional areas of the conductors 21*a* of the two power supply wires 2*a* and 2*a* are larger than the conductor sectional areas of the conductors 21*b* of the two signal wires 2*b* and 2*b*. Further, the outer diameters of the two power supply wires 2*a* and 2*a* are larger than the outer diameters of the two signal wires 2*b* and 2*b*. FIG. 3 shows a case in which an inner sheath 23 is provided on a periphery of the twisted wire pair 24, but the inner sheath 23 can be omitted. The inner sheath 23 is made of, for example, a urethane.

SUMMARY OF THE EMBODIMENTS

Next, the technical ideas grasped from the above-described embodiments will be described with the aid of the reference characters and the like in the embodiments. It should be noted, however, that each of the reference characters and the like in the following descriptions is not to be construed as limiting the elements in the claims to the members and the like specifically shown in the embodiments.

[1] A multicore cable (1), comprising: a bunched core (3) composed of a plurality of electric wires (2) laid together, each including a conductor (21), and a electrical insulating member (22) provided over a periphery of the conductor (21); an abrasion suppressing layer (4) configured as a taping member (41) helically wrapped around a periphery of the bunched core (3); a shielding layer (5) composed of a braided shield provided over an outer periphery of the abrasion suppressing layer (4); and a sheath (6) provided over a periphery of the shielding layer (5), wherein an opposite surface of the taping member (41) of the abrasion suppressing layer (4) to the bunched core (3) and an opposite surface of the taping member (41) of the abrasion suppressing layer (4) to the shielding layer (5) are composed of a fluoropolymer resin, with the taping member (41) of the abrasion suppressing layer (4) being non-adhesively lap wound in such a manner as to partially overlap itself in a width direction of that taping member (41).

[2] The multicore cable (1) according to [1] above, wherein a wrapping direction of the taping member (41) of the abrasion suppressing layer (4) is the same as a lay direction of the bunched core (3).

[3] The multicore cable (1) according to [1] or [2] above, wherein a coefficient of a friction on the opposite surface of the taping member (41) of the abrasion suppressing layer (4) to the bunched core (3) and a coefficient of the friction on the opposite surface of the taping member (41) of the abrasion suppressing layer (4) to the shielding layer (5) are lower than coefficients of the friction on surfaces of the electrical insulating members (22) of the plurality of electric wires (2) constituting the bunched core (3).

[4] The multicore cable (1) according to any one of [1] to [3] above, wherein at least one of the plurality of electric wires (2) constituting the bunched core (3) is configured in such a manner that the conductor (21) thereof can be moved independently of the electrical insulating member (22) thereof.

[5] The multicore cable (1) according to any one of [1] to [4] above, further comprising an air layer formed partially in a circumferential direction thereof between the shielding layer (5) and the abrasion suppressing layer (4).

[6] The multicore cable (1) according to any one of [1] to [5] above, wherein the shielding layer (5) is composed of a plurality of layers of the braided shields laminated on top of each other in radial directions of the multicore cable (1), with a braiding angle of an innermost one (51) of the plurality of layers of the braided shields, which is provided in an innermost side of the shielding layer (5) in the radial directions of the multicore cable (1), being smaller than braiding angles of outer ones (52) of the plurality of layers of the braided shields, which are provided in an outer side of the shielding layer (5) relative to that innermost one (51) of the plurality of layers of the braided shields in the radial directions of the multicore cable (1).

[7] The multicore cable (1) according to any one of [1] to [6] above, wherein the shielding layer (5) is composed of a braided shield with metal wires braided together therein comprising a tensile strength of not lower than 340 MPa and an elongation of not lower than 5%.

[8] The multicore cable (1) according to [7] above, wherein the metal wires to be used in the shielding layer (5) are made of a tin-plated copper alloy.

[9] The multicore cable (1) according to [7] or [8] above, wherein the metal wires to be used in the shielding layer (5) are coated with a lubricant agent thereon.

[10] The multicore cable (1) according to any one of [1] to [9] above, wherein at least one of the plurality of electric wires (2) constituting the bunched core (3) comprises a conductor cross-sectional area of the conductor (21) thereof of not smaller than 0.75 $mm^2$.

[11] The multicore cable (1) according to any one of [1] to [10] above, wherein the conductor (21) of at least one of the plurality of electric wires (2) constituting the bunched core (3) is made of a composite stranded wire produced by using a plurality of child stranded wires each composed of a plurality of metal wires stranded together, and further stranding the plurality of child stranded wires together.

Although the embodiments of the present invention have been described above, the above described embodiments are not to be construed as limiting the inventions according to the appended claims. Further, it should be noted that not all the combinations of the features described in the embodiments are indispensable to the means for solving the problem of the invention.

The present invention can be appropriately modified and implemented without departing from the spirit thereof.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A multicore cable, comprising:

a bunched core including a plurality of electric wires laid together, each including a conductor, and an electrical insulating member provided over a periphery of the conductor;

an abrasion suppressing layer configured as a taping member helically wrapped around a periphery of the bunched core, the abrasion suppressing layer directly contacting with the electrical insulating member, the abrasion suppressing layer passing into valley portions between the plurality of electric wires;

a shielding layer including a plurality of layers of braided shields provided over an outer periphery of the abrasion suppressing layer;

a sheath provided over a periphery of the shielding layer; and an air layer formed between the shielding layer and the abrasion suppressing layer passing into the valley portions, wherein an opposite surface of the taping member of the abrasion suppressing layer to the bunched core and an opposite surface of the taping member of the abrasion suppressing layer to the shielding layer include a fluoropolymer resin, with the taping member of the abrasion suppressing layer being non-adhesively lap wound in such a manner as to partially overlap itself in a width direction of the taping member, and wherein the plurality of layers of the braided shields are laminated on top of each other in radial directions of the multicore cable, with a braiding an of an innermost one of the plurality of layers of the braided shields, which is provided in an innermost side of the shielding layer in the radial directions of the multicore cable being smaller than braiding angles of outer ones of the plurality of layers of the braided shields, which are provided in an outer side of the shielding layer relative to said innermost one of the plurality of layers of the braided shields in the radial directions of the multicore cable.

2. The multicore cable according to claim 1, wherein a wrapping direction of the taping member of the abrasion suppressing layer is the same as a lay direction of the bunched core.

3. The multicore cable according to claim 1, wherein a coefficient of a friction on the opposite surface of the taping member of the abrasion suppressing layer to the bunched core and a coefficient of the friction on the opposite surface of the taping member of the abrasion suppressing layer to the shielding layer are lower than coefficients of the friction on surfaces of the electrical insulating members of the plurality of electric wires constituting the bunched core.

4. The multicore cable according to claim 1, wherein at least one of the plurality of electric wires, constituting the bunched core, is configured in such a manner that the conductor thereof is configured to be moved independently of the electrical insulating member thereof.

5. The multicore cable according to claim 1, wherein the braided shields include metal wires braided together therein having a tensile strength of not lower than 340 MPa and an elongation of not lower than 5%.

6. The multicore cable according to claim 5, wherein the metal wires in the shielding layer include a tin-plated copper alloy.

7. The multicore cable according to claim 5, wherein the metal wires in the shielding layer are coated with a lubricant agent thereon.

8. The multicore cable according to claim 1, wherein at least one of the plurality of electric wires constituting the bunched core comprises a conductor cross-sectional area of the conductor thereof of not smaller than 0.75 $mm^2$.

9. The multicore cable according to claim 1, wherein the conductor of at least one of the plurality of electric wires constituting the bunched core includes a composite stranded wire produced by using a plurality of child stranded wires each including a plurality of metal wires stranded together, and further stranding the plurality of child stranded wires together.

10. The multicore cable according to claim 1, wherein the abrasion suppressing layer contacts each of the plurality of electric wires.

11. The multicore cable according to claim 1, wherein the abrasion suppressing layer abuts the electrical insulating member of each of the plurality of electric wires.

12. The multicore cable according to claim 1, wherein the abrasion suppressing layer contacts a part of the shielding layer.

13. The multicore cable according to claim 1, wherein the abrasion suppressing layer abuts a part of an inner surface of the shielding layer.

14. The multicore cable according to claim 1, wherein, in a circumferential direction of the air layer, the abrasion suppressing layer spaces apart a first portion of the air layer from a second portion of the air layer.

15. The multicore cable according to claim 1, wherein, in a circumferential direction of the air layer, the air layer includes a plurality of layers each confined between the abrasion suppressing layer and the shielding layer.

16. A multicore cable, comprising:

a bunched core including a plurality of electric wires laid together, each including a conductor, and an electrical insulating member provided over a periphery of the conductor;

an abrasion suppressing layer configured as taping member helically wrapped around a periphery of the bunched core, the abrasion suppressing layer directly contacting with the electrical insulating member, the abrasion suppressing layer passing into valley portions between the plurality of electric wires;

a shielding layer provided over an outer periphery of the abrasion suppressing layer;

a sheath provided over a periphery of the shielding layer; and an air layer formed between the shielding layer and the abrasion suppressing layer passing into the valley portions, wherein an opposite surface of the taping member of the abrasion suppressing layer to the bunched core and an opposite surface of the taping member of the abrasion suppressing layer to the shielding layer include a fluoropolymer resin, with the taping member of the abrasion suppressing layer being non-adhesively lap wound in such a manner as to partially overlap itself in a width direction of the taping member, wherein the shielding layer includes:

an outer braided shield; and an inner braided shield disposed between the outer braided shield and the abrasion suppressing layer, and wherein a braiding angle of the inner braided shield is different from a braiding angle of the outer braided shield.

17. The multicore cable according to claim 16, wherein the air layer abuts a first portion of a circumferential surface of the inner braided shield.

18. The multicore cable according to claim 17, wherein the abrasion suppressing layer abuts a second portion of the circumferential surface of the inner braided shield.

* * * * *